US005421959A

United States Patent [19]

Oka et al.

[11] Patent Number: 5,421,959

[45] Date of Patent: Jun. 6, 1995

[54] COMPOSITE COMPRISING PAPER AND ELECTRO-CONDUCTING POLYMERS AND ITS PRODUCTION PROCESS

[75] Inventors: Osamu Oka, Shizuoka; Katsumi Yoshino, 166-3, Obu-cho, Kishiwada-shi, Osaka, both of Japan

[73] Assignees: Tomegawa Paper Co., Ltd., Tokyo; Katsumi Yoshino, Kishiwada, both of Japan

[21] Appl. No.: 196,385

[22] Filed: Feb. 15, 1994

Related U.S. Application Data

[63] Continuation of Ser. No. 183,773, Jan. 21, 1994, Pat. No. 5,336,374, which is a continuation of Ser. No. 996,496, Dec. 30, 1992, abandoned, which is a continuation of Ser. No. 696,850, May 7, 1991, abandoned.

[30] Foreign Application Priority Data

May 10, 1990 [JP] Japan ..... 2-118778
Feb. 7, 1991 [JP] Japan ..... 3-36570

[51] Int. Cl.[6] ..... D21H 27/00

[52] U.S. Cl. ..... 162/138; 162/135; 162/164.5; 162/168.1; 162/168.6; 162/182; 162/192; 205/159; 205/317

[58] Field of Search ..... 427/121; 162/138, 192, 162/168.1, 168.2, 182, 164.5, 9, 135, 164.6, 168.6; 205/159, 317, 160

[56] References Cited

U.S. PATENT DOCUMENTS 3,702,799 11/1972 Lewis et al. ..... 162/138
3,708,289 1/1973 Timmerman et al. ..... 162/138
4,521,450 6/1985 Bjorklund et al. ..... 427/121
4,547,270 10/1985 Naarman ..... 205/317
4,582,575 4/1986 Warren ..... 205/317
4,710,400 1/1987 Gardini et al. ..... 427/121
4,981,718 1/1991 Kuhn et al. ..... 427/121
5,030,508 9/1991 Kuhn et al. ..... 428/253

FOREIGN PATENT DOCUMENTS 0206133 12/1986 European Pat. Off. .
0206414 12/1986 European Pat. Off. .
0352882 1/1990 European Pat. Off. .

OTHER PUBLICATIONS

Bjorklund et al., "Some Properties of Polypyrrole-Paper Composites", Journal of Electronic Materials, vol. 13, No. 1, 1984, pp. 211-230.

*Primary Examiner*—Peter Chin
*Attorney, Agent, or Firm*—Cushman Darby & Cushman

[57] ABSTRACT

A composite comprising a paper and a conjugated electroconducting polymer, the conjugated electroconducting polymer existing between fibers or in close contact with fibers of the paper, is disclosed. A process for producing a composite comprising a paper and a conjugated electroconducting polymer, the conjugated electroconducting polymer existing between fibers or in close contact with fibers of the paper, which comprises subjecting a conjugated compound to electropolymerization or oxidation polymerization in the presence of a paper, is also disclosed. A process for producing a functional composite, which comprises impregnating a paper with a solution of a precursor polymer of a conjugated electroconducting polymer and heat treating the paper to form a conjugated electroconducting polymer between or on surface of fibers of the paper, is further disclosed.

8 Claims, No Drawings

COMPOSITE COMPRISING PAPER AND ELECTRO-CONDUCTING POLYMERS AND ITS PRODUCTION PROCESS

This is a continuation of application Ser. No. 08/183,773, filed Jan. 21, 1994, now U.S. Pat. No. 5,336,374, which is a continuation of application Ser. No. 07/996,496 filed Dec. 30, 1992, now abandoned; which is a continuation of application Ser. No. 07/696,850 filed May 7, 1991, now abandoned.

FIELD OF THE INVENTION

The present invention relates to a composite comprising a paper and an electroconducting polymer having a grown conjugated system at the main chain thereof and a process for producing the same. More specifically, the invention relates to a composite comprising a paper and a conjugated electroconducting polymer having improved fabrication and stability without impairing inherent characteristics of the conjugated electroconducting polymer and a process for producing the same.

BACKGROUND OF THE INVENTION

An electroconducting polymer having a highly grown conjugated system at the main chain thereof causes insulator-metal transition by doping with a dopant which is an electron donor or an electron acceptor, whereby the conductivity thereof can be desirably controlled. Furthermore, with the transition, optical and magnetic properties of the compound are largely changed. Accordingly, such an electroconducting polymer has been widely noticed as a functional material capable of making various functional applications by utilizing the above-described properties.

Recently, with the development of various kinds of electroconducting polymers, utilization of the conjugated electroconducting polymer to electrodes for batteries, electrochemical sensors, electrochromic devices, etc., has been highly expected.

Since conventional conjugated electroconducting polymers are generally insoluble in almost all of solvents and are not melted even by heating, the polymers had a large disadvantage of poor fabrication. Recently, electroconducting polymers soluble in solvents and fusible electroconducting polymers capable of undergoing melt molding by heating have been developed. However, it is the present status that these conjugated electroconducting polymers have not yet had sufficient fabrication, or if these polymers are given sufficient fabrication, the inherent characteristics of these compounds are impaired.

Also, when a conjugated compound is subjected to electropolymerization, a conjugated electroconducting polymer may be obtained in a film form. However, in almost all cases, conjugated electroconducting polymers keeping a film form cannot be obtained, and these compounds have a fault that they form a thin layer or deposit as a powder on an electrode.

Also, when a precursor polymer of a conjugated electroconducting polymer is cast and heat treated, a conjugated electroconducting polymer may be obtained in a film form. However, in almost all cases, it was impossible to obtain a film having sufficient flexibility. Furthermore, it has been attempted to form composites with general-purpose polymer films by utilizing electropolymerization or chemical polymerization, but there is a limitation on obtainable composites.

SUMMARY OF THE INVENTION

As a result of various investigations for solving the above-described problems, the present inventors have discovered a composite composed of a paper and a conjugated electroconducting polymer having improved fabrication and stability without impairing inherent characteristics of the conjugated electroconducting polymer and also a process of producing the aforesaid composite.

That is, an object of the present invention is to provide a composite comprising a paper and a conjugated electroconducting polymer having improved fabrication and stability without impairing inherent characteristics of the conjugated electroconducting polymer.

Thus, in one embodiment of the present invention, the invention provides a composite comprising a paper and a conjugated electroconducting polymer, the conjugated electroconducting polymer existing between or in close contact with fibers of the paper.

In another embodiment of the present invention, the invention provides a process for producing a composite comprising a paper and a conjugated electroconducting polymer, the conjugated electroconducting polymer existing between or in close contact with fibers of the paper, which comprises subjecting a conjugated compound to electropolymerization or oxidation polymerization in the presence of a paper.

Also, in a further embodiment of the present invention, the invention provides a process for producing a functional composite, which comprises impregnating a paper with a solution of a precursor polymer of a conjugated electroconducting polymer and heat treating the paper to form a conjugated electroconducting polymer between or on surfaces of fibers of the paper.

DETAILED DESCRIPTION OF THE INVENTION

As to the paper for use in this invention, there is no particular restriction if the paper can sufficiently endure under the circumstances of the polymerization of the conjugated compound, or the circumstances of being impregnated with a solution of the soluble precursor polymer and of the heat treatment, and using the composite. For example, uncoated papers for printing, original papers for thermal recording papers, original papers for copying papers, packaging papers, electrical insulating papers, and synthetic papers such as synthetic fiber papers and plastic foam papers can be used. Also, cloths, nonwoven fabrics, etc., can be used.

As the conjugated compound for obtaining the conjugated electroconducting polymer for use in this invention, for example, the following compounds can be used.

(1) Benzene and derivatives thereof:

Benzene and substituted benzenes having no more than 4 substituent groups can be used. Specific examples include aniline, phenol, thiophenol, toluene, anisole, aminothiophenol, o- and m-toluenesulfonic acids, and substituted compounds thereof. Examples of the substituent group for the substituted compounds include a straight chain alkyl group (such as methyl, ethyl, propyl, butyl, pentyl, hexyl, heptyl, octyl, nonyl, decyl, undecyl, dodecyl, hexadecyl), a cyclic alkyl group (such as cyclohexyl, cyclopentyl), a branched alkyl group (such as isopropyl, t-butyl), an alkoxy group (such as methoxy, ethoxy, propoxy), an alkynyl group, an amino group, an aryl group, an allyl group, a carboxyl group, a nitro group, a halogen atom, a cyano group, and a sulfonic acid group. A part of the hydrogens of the alkyl group may be substituted by an alkoxy group, an alkenyl group, an amino group, an aryl group, an allyl group, a carboxyl group, a nitro group, a halogen atom, a cyano group, a sulfonic acid group, etc.

(2) Condensed polycyclic compounds and derivatives thereof:

Specific examples include naphthalene, fluorene, anthracene, phenanthrene, pyrene, coronene, and substituted compounds thereof. Specific examples of the substituted compounds include α- and β-aminonaphthalenes, aminoanthracene, aminocoronene, alkylfluorenes, and substituted compounds thereof.

These substituted compounds may have the substituent group as described in (1) above.

(3) Heterocyclic aromatic compounds and derivatives thereof:

Specific examples include pyrrole, furan, thiophene, selenophene, carbazole, pyridine, oxazole, thiazole, and substituted compounds thereof.

Specific examples of the substituted compounds include -alkylpyrroles, N-alkylpyrroles, 3,4-dialkylpyrroles, 3-alkylfurans, 3,4-dialkylfurans, 3-alkylthiophenes, 3,4-dialkylthiophenes, 3-alkylselenophenes, 3,4-dialkylselenophenes, and substituted compounds thereof.

These substituted compounds may have the substituent group as described in (1) above.

As the precursor polymer of conjugated electroconducting polymer for use in the present invention, for example, the following compounds can be used.

(4) Derivatives of poly(5,5-hydroxycyclohexene) represented by formula (I):

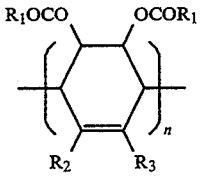

(I)

wherein $R_1$ represents a lower alkyl group or a lower alkoxy group; $R_2$ and $R_3$ each represents a hydrogen atom, an alkyl group, a substituted alkyl group, an alkoxy group, an aryl group, or a halogen atom; and n represents an integer of 8 or more.

The compounds shown by formula (I) can be obtained by radical polymerization of a 5,6-dihydroxycyclohexa-1,3-diene derivative represented by formula (II):

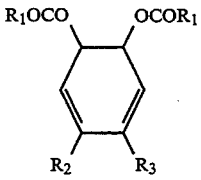

(II)

wherein $R_1$, $R_2$, and $R_3$ have the same meanings as described above.

(5) Compounds represented by formulae (III) and (IV):

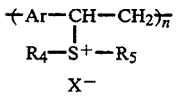

(III)

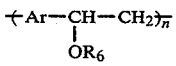

(IV)

wherein $R_4$ and $R_5$, which may be the same or different, each represents an alkyl group; $R_6$ represents a lower alkyl group; X represents a halogen atom or a halogen compound (such as $BF_4$); Ar represents a p-phenylene group, a 1,4-naphthylene group, a 2,5-thienylene group, or a 2,5-furylene group, each of which groups may have a substituent group; and n represents an integer of 8 or more.

Examples of the substituent group for Ar of the compounds shown by formulae (III) and (IV) include an alkyl group (such as methyl, ethyl, propyl, butyl, pentyl, hexyl, heptyl, octyl, nonyl, decyl, dodecyl, docosyl), an alkoxy group (such as methoxy, ethoxy, propoxy), an alkenyl group, an amino group, an aryl group, a halogen atom, and a cyano group.

In addition, the sulfonium salt of the polymer shown by formula (III) can be obtained by adding, for example, an aqueous solution of a basic hydroxide to an aqueous solution of a compound represented by formula (V):

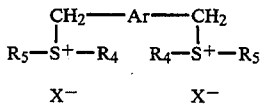

(V)

wherein $R_4$, $R_5$, Ar, and X have the same meanings as described above, and polymerizing the mixture.

Also, the polymer derivative which is substituted by an alkoxy group, as shown by formula (IV), can be obtained by solvolysis of the compound shown by formula (III) with an alcohol shown by $R_6(OH)$, wherein $R_6$ has the same meaning as described above.

As a solvent for the precursor polymer shown by formulae (I), (III), or (IV), water, alcohol solvents (such as methanol, ethanol), ether solvents (such as tetrahydrofuran), amide solvents (such as N,N-dimethylformamide), other polar solvents, and mixtures thereof can be used.

The composite of this invention can be produced by electropolymerization or oxidation polymerization of the conjugated compound in the presence of a paper.

The electropolymerization is carried out by bring a paper in close contact with an electrode or attaching a metal to a paper by vapor deposition, plating, etc. to form a working electrode, placing the paper in a solution of the conjugated compound, and undergoing electropolymerization under a condition of constant potential, constant current, constant voltage, etc.

As a solvent for dissolving the conjugated compound, water, an organic solvent, or a mixture thereof can be used. As the electrode, a noble metal electrode (such as those made of gold, platinum, etc.), a nickel electrode, a chromium electrode, a carbon electrode, and a glass electrode having vapor deposited thereon indium(II) oxide, stannic oxide, etc. are preferably used, but the invention is not limited to these kinds of electrode materials and forming method of working electrodes and counter electrodes.

As the oxidation polymerization method, a method for impregnating a paper with a solution of the conjugated compound and bringing the paper into contact with an oxidizing agent, a method for impregnating a paper with an oxidizing agent and bringing the paper into contact with the conjugated compound.

As the oxidizing agent, for example, ammonium persulfate, hydrogen peroxide, potassium permanganate, and ferric chloride can be used.

Also, when the conjugated electroconducting polymer for use in this invention is soluble in a solvent, the composite of this invention can be produced by impregnating a paper with a solution of the conjugated polymer, followed by drying.

For impregnating a paper with a solution of the precursor polymer, a method of impregnation by an immersion method using an immersion apparatus, a method of impregnation by an on-machine coating using a wet type paper making machine, or a method of coating by an off-machine using a coating apparatus may be used.

The heat treatment after impregnation is carried out in an inert gas such as a nitrogen gas or an argon gas, or under reduced pressure. Also, the heating temperature is preferably from 100° C. to 500° C., and the heating time is usually from 10 minutes to 24 hours.

The conjugated electroconducting polymer formed by the above-described heat treatment is poly-p-phenylene and derivatives thereof from the precursor polymer shown by formula (I) and polyarlylenevinylenes and derivatives thereof from the precursor polymer shown by formula (III) or (IV), respectively.

The composite comprising a paper and a conjugated electroconducting polymer of this invention can be applied for use of wide ranges such as, for example, electrodes for primary and secondary batteries, packing papers having an antistatic function, electromagnetic shielding materials, etc., by properly selecting the form and shape of paper as a substrate. Furthermore, even a conventional conjugated electroconducting polymer which is obtained only as a powder or a conventional conjugated electroconducting high molecular weight compound which scarcely grows on an electrode can be used in the present invention while utilizing the characteristics thereof.

The following examples are intended to illustrate the present invention more practically but not to limit it in any way.

EXAMPLE 1

An electrical insulating paper having a thickness of 30 μm was vapor deposited with gold, and after connecting a leading wire thereto, the vapor deposited portion was fixedly covered with an epoxy resin to electrically insulate the portion. An electrode thus prepared was immersed in an electrolyte having an aniline concentration of 0.1 mole/liter and a hydrochloric acid concentration of 0.2 mole/liter, and electropolymerization was carried out by using a platinum plate as a counter electrode at a constant voltage of 1.5 volts and at a quantity of electricity of 3 coulombs. Thus, polyaniline deposited on the substantially entire surface of the paper. When the composite was used as a positive electrode as it was and the charging and discharging characteristics thereof were measured in a propylene carbonate solution of 0.1 mole/liter of lithium perchlorate, the coulomb efficiency was 98%, which showed excellent electric conducting property.

EXAMPLE 2

A paper for printing having a thickness of 60 μm was vapor deposited with gold, and after connecting a leading wire thereto, the vapor deposited portion was fixedly covered with an epoxy resin to electrically insulate the portion. An electrode thus prepared was immersed in an electrolyte having an aniline concentration of 0.1 mole/liter and a hydrochloric acid concentration of 0.2 mole/liter, and electropolymerization was carried out by using a platinum plate as a counter electrode at a constant voltage of 1.5 volts and at a quantity of electricity of 3 coulombs. Thus, polyaniline grew in the inside of the paper. The coulomb efficiency of the composite was 96% as in Example 1, which showed excellent electric conducting property.

EXAMPLE 3

An electrical insulating paper having a thickness of 30 μm was immersed in an electrolyte having an aniline concentration of 0.1 mole/liter and a hydrochloric acid concentration of 0.2 mole/liter, and after sandwiching the paper between two platinum-plates, electropolymerization was carried out at a constant voltage of 1.5 volts and at a quantity of electricity of 3 coulombs. Thus, polyaniline deposited on the substantially entire surface of the paper to provide a green composite in a doped state. The coulomb efficiency of the composite was 95% as in Example 1, and the electric conductivity thereof was 0.1 S/cm in a dry state.

EXAMPLE 4

After impregnating a paper for printing having a thickness of 60 μm with an aqueous solution having an aniline concentration of 0.1 mole/liter and a hydrochloric acid concentration of 0.2 mole/liter, the paper was immersed in an aqueous solution having an ammonium persulfate concentration of 0.1 mole/liter for 4 hours to effect oxidation polymerization. Thus, polyaniline deposited on the substantially entire surface of the paper to provide a green composite in a doped state. The coulomb efficiency of the composite was 95% as in Example 1, and the electric conductivity was 0.3 S/cm in a dry state.

EXAMPLE 5

An electrical insulating paper having a thickness of 30 μm was vapor deposited with gold, and after-connecting thereto a leading wire, the vapor deposited portion was fixedly covered with a epoxy resin to electrically insulate the portion. An electrode thus prepared was immersed in an electrolyte having a 3-anilinopropionitrile concentration of 0.1 mole/liter and a hydrochloric acid concentration of 0.2 mole/liter, and electropolymerization was carried out by using a platinum plate as a counter electrode at a constant voltage of 1.5 volts and at a quantity of electricity of 1 coulomb. Thus, the polymer grew in the inside of the paper.. The coulomb efficiency of the composite was 95% as in Example 1, which showed excellent electric conducting property.

EXAMPLE 6

An electrical,insulating paper having a thickness of 30 μm was vapor deposited with gold, and after connecting thereto a leading wire, the vapor deposited portion was fixedly covered with an epoxy resin to electrically insulate the portion. An electrode thus prepared was immersed in a propylene carbonate solution containing 2 mmole of thiophene and 1 mmole of tetraethylammonium tetrafluoroborate, and electropolymerization was carried out in an argon atmosphere by using a nesa glass as a counter electrode at a constant voltage of 10 volts and at a quantity of electricity of 1 coulomb. Thus, a blue paper having the polymer grown in the inside thereof was obtained. The coulomb efficiency of the composite was almost 95% as in Example 1. In this case, the composite was red in an undoped state, and the electric conductivity was $10^{-11}$ S/cm. Furthermore, doping and undoping were repeatedly applied, and according thereto, the composite could show blue and red.

EXAMPLE 7

A nesa glass was brought into close contact with an electrical insulating paper having a thickness of 30 μm. The assembly was used as an electrode and immersed in a propylene carbonate solution containing 2 mmole of thiophene and 1 mmole of tetraethylammonium tetrafluoroborate, and electropolymerization was carried out in an argon atmosphere by using a platinum plate as a counter electrode at a constant voltage of 12 volts and at a quantity of electricity of 1 coulomb. Thus, a blue paper having the polymer grown in the inside thereof was obtained. The coulomb efficiency of the composite was 95% as in Example 1. In this case, the composite was red in an undoped state, and the electric conductivity was $10^{-11}$ S/cm. Furthermore, doping and undoping were repeatedly applied, and according thereto, the composite could show blue and red.

EXAMPLE 8

An electrical insulating paper having a thickness of 30 μm was vapor deposited with gold, and after connecting thereto a leading wire, the vapor deposited portion was fixedly covered with an epoxy resin to electrically insulate the portion. An electrode thus prepared was immersed in a propylene carbonate solution containing 2 mmole of pyrrole and 1 mmole of tetraethylammonium tetrafluoroborate, and electropolymerization was carried out in an argon atmosphere by using a platinum plate as a counter electrode at a constant voltage of 1.5 volts and at a quantity of electricity of 1 coulomb. In this case, the polymer grew in the inside of the paper. The coulomb efficiency of the composite was 95% as in example 1, which showed excellent electric conducting property.

EXAMPLE 9

A nesa glass was brought into close contact with an electrical insulating paper having a thickness of 30 μm. The assembly was used as an electrode and immersed in an aqueous solution containing 2 mmole of pyrrole and 3 mmole of p-toluenesulfonic acid, and electropolymerization was carried out in an argon atmosphere by using a nesa glass as a counter electrode at a constant voltage of 2.0 volts and at a quantity of electricity of 1 coulomb. In this case, the polymer grew in the inside of the paper. The coulomb efficiency of the composite was 95% as in Example 1, which showed excellent electric conducting property.

EXAMPLE 10

By bulk polymerizing 2 g of a methylcarbonic acid ester of 5,6-dihydroxycyclohexa-1,3-diene (a compound of formula (II), wherein $R_1$ is a methoxy group, and $R_2$ and $R_3$ each is a hydrogen atom) for 3 hours at 50° C. by using 2,2'-azobis(4-methoxy-2,4-dimethylvaleronitrile) as a radical polymerization initiator to provide a precursor polymer having n of about 700. The compound was dissolved in toluene, and a paper for printing having a thickness of 60 μm was immersed in the solution, sufficiently impregnated with a precursor polymer shown by formula (I), and then heat treated at 200° C. for 3 hours under reduced pressure to provide a pale yellow functional composite.

The composite could be doped. When the composite was exposed to an- iodine vapor, it changed to black, and the electric conductivity was 0.5 S/cm. Also, the tensile strength of the composite was 130 MPa, Which was stronger than the paper. Furthermore, the composite could be electrochemically doped, and by doping the composite with $AsF_6^-$ in a propylene carbonate solution of 0.1M of $LiAsF_6$, the composite changed to blue.

Also, a battery was formed by combining with lithium and a propylene carbonate solution of 0.1M of $LiAsF_6$. The voltage at the open end was 4.1 volts, and an energy density was 75 wh/kg.

EXAMPLE 11

To an aqueous solution of 0.2 mole/liter of p-xylenebis(dimethylsulfonium chloride) obtained from 1,4-bis(chloromethyl)benzene and dimethyl sulfide was added an equivalent amount of an aqueous solution of sodium hydroxide, and after reaction for one hour at 0° C. in a nitrogen gas stream, the reaction mixture was subjected to dialysis with respect to distilled water for 3 days by using a dialysis diaphragm having a differential molecular weight of 8000 to remove low-molecular weight portions, whereby an aqueous solution of poly[p-xylenebis(dimethylsulfoniumchloride)] as a precursor polymer shown by formula (III) (wherein Ar is a p-phenylene group, $R_4$ and $R_5$ are each a methyl group, and X is Cl) was obtained. A paper for printing having a thickness of 60 μm was immersed in the aqueous solution, sufficiently impregnated with the precursor polymer, and then heat treated at 200° C. for about 3 hours under reduced pressure to provide a pale yellow functional composite.

The composite obtained could be doped, and when the composite was exposed to an iodine vapor, it changed to black. The electric conductivity of the composite was $10^{-5}$ S/cm (measured by a 4-terminal method). Also, the tensile strength of the composite was 120 MPa, which was stronger than the paper. Furthermore, the composite could be electrochemically doped, and when the composite was doped with a perchloric acid ion in an acetonitrile solution of 0.1M of tetra-n-butylammonium perchlorate, it changed to blue.

Also, a battery was formed by combining with lithium and a propylene carbonate solution of 0.1M of lithium perchlorate. The voltage at the open end was 3.6 volts, and the energy density was 55 wh/kg.

EXAMPLE 12

By following the same procedure as in Example 11 except that 1,4-bis(chloromethyl)-2,5-diethoxybenzene was used in place of the 1,4-bis(chloromethyl)benzene, to obtain an aqueous solution of poly[2,5-dimethoxy-p-xylenebis(dimethylsulfonium chloride)] as a precursor polymer shown by formula (III) (wherein Ar is a 2,5-dimethoxy-p-phenylene group, $R_4$ and $R_5$ are each a methyl group, and X is Cl) from which a red functional composite was then obtained. The composite became black by doping with iodine, and the electric conductivity of the composite was 1 S/cm. Also, the tensile strength of the composite was 110 MPa, which was stronger than the paper. Furthermore, the composite could be electrochemically doped, and by doping the composite with a perchloric acid ion in an acetonitrile solution of 0.1M of tetra-n-butylammonium perchlorate, it changed to blue.

Also, a battery was formed by combining with lithium and a propylene carbonate solution of 0.1M of lithium perchlorate. The voltage at the open end was 3.5 volts, and the energy density was 60 wh/kg.

EXAMPLE 13

By following the same procedure as in Example 11 except that 1,4-bis(chloromethyl)-2,5-diethoxybenzene was used in place of the 1,4-bis(chloromethyl)benzene, to obtain an aqueous solution of poly[2,5-diethoxy-p-xylenebis(dimethylsulfonium chloride)] as a precursor polymer shown by formula (III) (wherein Ar is a 2,5-diethoxy-p-phenylene group, $R_4$ and $R_5$ are each a methyl group, and X is Cl) from which a red functional composite war then obtained. The composite became black by doping with iodine, and the electric conductivity was 3 S/cm. Also, the tensile strength of the composite was 110 MPa, which was stronger than the paper. Furthermore, the composite could be electrochemically doped, and by doping the composite with a perchloric acid ion in an acetonitrile solution of 0.1M of tetra-n-butylammonium perchlorate, it changed to blue.

Also, a battery was formed by combining with lithium and a propylene carbonate solution of 0.1M of lithium perchlorate. The voltage at the open end was 3.5 volts, and the energy density was 65 wh/kg.

EXAMPLE 14

By following the same procedure as in Example 11 except that 2,5-bis(chloromethyl)thiophene was used in place of the 1,4-bis(chloromethyl)benzene and that a mixed solvent of water and methanol was used as the solvent, a red functional composite impregnated with a precursor polymer shown by formula (IV) (wherein Ar is a 2,5-thienylene group, and $R_6$ is a methyl group) was then obtained. The composite became black by doping with iodine, and the electric conductivity was 1.5 S/cm. Also, the tensile strength of the composite was 120 MPa, which was stronger than the paper. Furthermore, the composite could be electrochemically doped, and by doping the composite with a perchloric acid ion in an acetonitrile solution of 0.1M of tetra-n-butylammonium perchlorate, it changed to blue.

Also, a battery was formed by combining with lithium and a propylene carbonate solution of 0.1M of lithium perchlorate. The voltage at the open end was 3.0 volts, and the energy density was 50 wh/kg.

While the invention has been described in detail and with reference to specific examples thereof, it will be apparent to one skilled in the art that various changes and modifications can be made therein without departing from the spirit and scope thereof.

What is claimed is:

1. A process for producing a functional composite, which comprises impregnating a paper with a solution of a precursor polymer of a conjugated electroconducting polymer and heat treating the paper to form a conjugated electroconducting polymer between or on surface of fibers of the paper, wherein said precursor polymer is selected from the group consisting of the compounds of formulae (I), (III) and (IV):

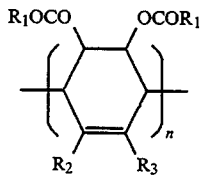

(I)

wherein $R_1$ represents a lower alkyl group or a lower alkoxy group, $R_2$ and $R_3$ each represents a hydrogen atom, an alkyl group, a substituted alkyl group, an alkoxy group, an aryl group, or a halogen atom, and n represents an integer of 8 or more;

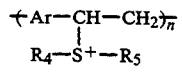

(III)

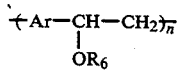

(IV)

wherein $R_4$ and $R_5$, which may be the same or different, each represents an alkyl group, $R_6$ represents a lower alkyl group, X represents a halogen atom or a halogen compound, Ar represents a p-phenylene group, a 1,4-naphthylene group, a 2,5-thienylene group, or a 2,5-furylene group, each of which groups may have a substituent group, and n represents an integer of 8 or more.

2. A process as in claim 1, wherein the substituent group for Ar is selected from the group consisting of an alkyl group, an alkoxy group, an alkenyl group, an amino group, an aryl group, a halogen atom, and a cyano group.

3. A process as in claim 1, wherein said precursor polymer is the compound of formula (I) wherein $R_1$ is a methoxy group, and $R_2$ and $R_3$ each is a hydrogen atom.

4. A process as in claim 1, wherein said precursor polymer is the compound of formula (III) wherein Ar is an unsubstituted p-phenylene group or a p-phenylene group substituted by methoxy groups or ethoxy groups at the 2 and 5 positions, $R_4$ and $R_5$ each is a methyl group, and X is a chlorine atom.

5. A process as in claim 1, wherein said precursor polymer is the compound of formula (IV) wherein Ar is a 2,5-thienylene group and $R_6$ is a methyl group.

6. A process as in claim 1, wherein said heat treating is carried out in an inert gas or under reduced pressure.

7. A process as in claim 1, wherein said heat treating is carried out at a temperature of 100° to 500° C.

8. A process as in claim 1, wherein said heat treating is carried out for 10 minutes to 24 hours.

* * * * *